US006550171B1

(12) United States Patent
De Werra et al.

(10) Patent No.: US 6,550,171 B1
(45) Date of Patent: Apr. 22, 2003

(54) LABELS FOR CONTAINERS

(75) Inventors: Marie-Christine De Werra, Gingins (CH); Sebastien Geremia, Lavigny (CH)

(73) Assignee: Applied Research Systems ARS Holding N.V., Curacao (AN)

( * ) Notice: Subject to any disclaimer, the term of this patent is extended or adjusted under 35 U.S.C. 154(b) by 0 days.

(21) Appl. No.: 09/433,623

(22) Filed: Nov. 3, 1999

Related U.S. Application Data

(63) Continuation of application No. PCT/GB98/01329, filed on May 8, 1998.

(30) Foreign Application Priority Data

May 8, 1997 (GB) ..... 9709385

(51) Int. Cl.[7] ..... G09F 3/10; G09F 3/00
(52) U.S. Cl. ..... 40/638; 40/310; 283/81
(58) Field of Search ..... 40/306, 310, 638; 283/81, 101, 103, 105, 900

(56) References Cited

U.S. PATENT DOCUMENTS

| | | | | | |
|---|---|---|---|---|---|
| 1,949,903 | A | * | 3/1934 | Fales | 40/310 X |
| 2,091,346 | A | | 8/1937 | Wright | |
| 3,484,976 | A | * | 12/1969 | Shea | 40/310 |
| 4,128,954 | A | * | 12/1978 | White | 40/310 |
| 4,312,523 | A | * | 1/1982 | Haines | 40/630 |
| 4,324,058 | A | * | 4/1982 | Sherwick et al. | 40/310 |
| 4,700,976 | A | * | 10/1987 | Loose | 283/81 X |
| 4,727,667 | A | * | 3/1988 | Ingle | 40/306 |
| 4,889,234 | A | * | 12/1989 | Sorensen et al. | 40/638 X |
| 4,973,088 | A | * | 11/1990 | Levy | 283/81 |
| 5,195,265 | A | * | 3/1993 | Klingenberg | 40/638 |
| 5,342,093 | A | * | 8/1994 | Weernink | 40/310 X |
| 5,535,536 | A | | 7/1996 | Comann | 40/310 |
| 5,597,634 | A | * | 1/1997 | Bloomer et al. | 40/360 X |
| 6,073,377 | A | * | 6/2000 | Mehta | 40/638 |

FOREIGN PATENT DOCUMENTS

| | | | | |
|---|---|---|---|---|
| DE | 2348595 | | 4/1975 | |
| DE | 3924790 | * | 2/1991 | 40/310 |
| EP | 0239273 | | 3/1987 | |
| EP | 0731434 | | 9/1996 | |
| GB | 659854 | * | 10/1951 | 40/306 |
| GB | 748426 | | 5/1956 | |

* cited by examiner

*Primary Examiner*—Brian K. Green
(74) *Attorney, Agent, or Firm*—Dickstein, Shapiro, Morin & Oshinsky, LLP.

(57) ABSTRACT

A container (2) has a first label part (4) adhesively attached thereto. The first label part (4) has a marking panel (12), and a second label part (6) adhesively attached to the first label part (4) so as to cover at least a portion of the marking panel (12), the second label part being detachable to uncover that portion of the marking panel (12).

11 Claims, 3 Drawing Sheets

LABELS FOR CONTAINERS

CROSS-REFERENCE TO RELATED APPLICATIONS

This is a continuation application of International Application PCT/GB98/01329, with an International filing date of May 8, 1998.

BACKGROUND OF THE INVENTION

This invention relates to labels for containers, containers with labels on and methods of applying labels to containers.

Drugs are sometimes supplied in a dehydrated form and then prior to use the drug is reconstituted by adding it to a suitable solvent. For example, a patient may be supplied with a vial of freeze dried drug and a cartridge of solvent for the drug. Prior to use, the patient has to reconstitute the drug with the contents of the cartridge and refill the cartridge with the solution of the drug. The drug is then injected. Typically a single dose is reconstituted at a time before being administered immediately, so that the reconstitution process must be undertaken whenever a dose of the drug is required. Whilst it would be theoretically more convenient to reconstitute multiple doses at a time and store the reconstituted drug for a period of time, say one to two weeks, this is not generally done. This is because there is a potential for confusion between those cartridges containing the reconstituted drug and those containing the solvent alone. Furthermore, since the drug will tend to have a limited shelf life once reconstituted, there is a risk that if the patient loses track of the time-elapsed since reconstitution, the reconstituted drug may be stored for too long and become ineffective. One way to overcome these problems might be to apply a new label over the old one onto which the reconstitution date is written. However, the inconvenience of the need to keep a supply of labels for all the cartridges to be relabelled would tend to negate the benefit of reconstituting multiple doses at once.

DESCRIPTION OF THE INVENTION

Viewed from one aspect, the present invention provides a container having a first label part adhesively attached thereto, said first label part comprising a marking panel, and a second label part adhesively attached to the first label part so as to cover at least a portion of the marking panel, said second label part being detachable to uncover said portion of the marking panel.

Viewed from another aspect, the invention provides a method of applying a label to a container, comprising adhesively attaching a first label part comprising a marking panel to the container and detachably covering at least a portion of the marking panel with a second label part by adhesively attaching said second label part to said first label part.

Viewed from a further aspect, the invention provides a label for a container, comprising a first label part to be adhesively attached to the container, said first label part comprising a marking panel, and a second label part to be adhesively attached to the first label part for covering at least a portion of the marking panel, wherein in use said second label part is detachable to uncover said portion of the marking panel.

In use of the container, the second label part may be detached to reveal the previously covered area of the first label part which may have different information on it. The different information may for example be relevant to a change or modification to the contents of the container.

In one preferred embodiment, the container holds a diluent for reconstitution with a drug in dehydrated form. The second label part may provide information relating to the diluent itself, whilst the area of the first label part which is to be uncovered may provide information about the reconstituted drug.

The first label part may be provided with all the information needed once the relevant area thereof has been uncovered. In some circumstances, however, it may be desirable to add additional information after detachment of the second label part. This is made possible by the marking panel provided on the first label part. The term marking panel means a panel on which information may be handwritten, stamped, printed etc.

In the case of a container of a reconstituted drug, the added information may for example consist of the date of reconstitution or a "use by" date calculated from the date of reconstitution.

It may be necessary to separate the second label part from the first label part with the aid of scissors or a knife. It is however preferred for the first and second label parts to be joined by a tearable join, so that a user can simply tear away the second label part, leaving the container labelled by the first label part. The user may need to hold the first label part against the container when tearing off the second label part, but preferably the adhesive attachment of the first label part to the container is such that the peel strength of the first label part is greater than the tearing strength of the tearable join. With such an arrangement, the second label part can be torn away without a user having to make a substantial effort to hold the first label part in place on the container.

Thus, viewed from a further aspect, the invention provides a label for a container, comprising a first label part to be adhesively attached to the container and a second label part to be adhesively attached to the first part for covering at least a portion of the first label part, the first and second label parts being joined by a tearable join, the first label part having adhesive on its underside such that the peel strength of the first label part is greater than the tearing strength of the tearable join.

To facilitate removal of the second label part whilst keeping the first label part in place on the container, the first label part preferably has a greater peel strength than the second label part. This may be achieved by providing the first label part with a much stronger adhesive than that of the second label part.

Preferably an area of the underside of the second label part, which overlies or is intended to overlie the writing panel, is free of adhesive. This is advantageous since it prevents residue from the adhesive being left on the marking panel once the second label part has been removed, which would make it more difficult to mark, e.g. write, on the panel. Thus in a preferred embodiment, the second label part has at least one area free of adhesive as well as an adhesive portion.

A user may be able to grip an edge portion of the second label part to remove it. Preferably, the second label part has a tab to facilitate it being gripped in order to detach it from the first label part.

The label may be wrapped round the circumference of a container, which may be cylindrical, for example right-circular cylindrical. Thus the first label part may be wrapped directly around the container with the second label part being wrapped at least partially over the first. The second label part is removed by unwrapping it and, if a tearable join is provided, tearing it off. If the second label part covers the first only partially, its length in the circumferential direction will be less than that of the first label part. Thus information provided on the first label part may be visible both before and after detachment of the second label part. In a preferred embodiment, however, the second label part has a circumferential length substantially equal to the circumference of the container. The second label part can then substantially cover the entire first label part before it is removed.

Whilst it would be possible for the first label part to have a circumferential length less than the circumference of the container, it is preferred for the first label part to be longer, e.g. at least 2% longer, preferably at least 5% longer, so that it overlaps itself when applied around the container. Such an overlapping arrangement assists the first label part in resisting unwrapping when the second label part is unwrapped.

It is preferred that the two label parts both have a circumferential length at least equal to the circumference of the container. The label may therefore be attached to the container by revolving the container through at least two full turns relative to a label. The label may be applied manually but is preferably applied by a known labelling machine. One way of carrying out such a method would be to set up the labelling machine to revolve the container through the correct circumferential amount, e.g. about two revolutions, rather than the usual one revolution employed with a normal label wrapped just once around the container.

BRIEF DESCRIPTION OF THE DRAWINGS

An embodiment of the present invention will now be described, by way of example only, with reference to the accompanying drawings, in which.

DESCRIPTION OF THE DRAWINGS

Figure 1:
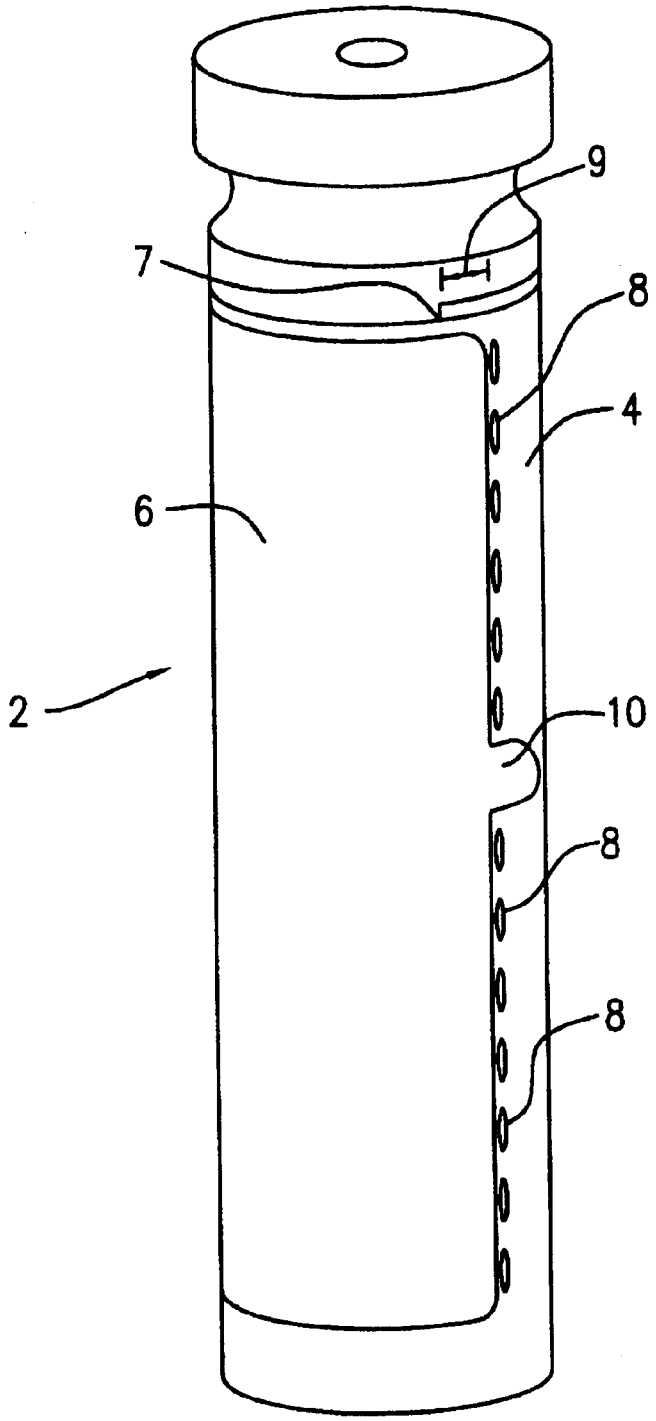
FIG. 1 is a schematic drawing of a container for pharmaceutical diluent having a two-part label attached thereto.

Referring to FIG. 1, there is shown a container in the form of a cartridge 2 for holding a diluent for dehydrated drugs. The cartridge 2 has a two-part label attached to it which comprises a first label part 4 wrapped around the container and a second label part 6 wrapped around the first label part. The label is shown as being slightly askew for reasons of clarity of explanation. The two-part label could be divided into its two parts merely by a printed indication of where it is to be cut, e.g. a dotted line, but in this embodiment. the first 4 and second 6 label parts are joined by a tearable join in the form of a line of perforations 8. The first label part 4 is slightly longer in the circumferential direction than the circumference of the cartridge so that it overlaps itself by overlapping length 9 and thus anchors its leading edge 7 against being lifted when the second label part 6 is unwrapped. The peel strength of the second label part 6 is less than that of the first label part 4 and is such that less force is required to remove the second label part 6 than is required to break the line of perforations 8. The perforations are substantially longer than the remaining bridging portions in order to minimize the tearing strength of the line of perforations. A tab 10 is provided on one end of the second label part 6 to facilitate pulling it off. The underside of the tab 10 does not have any adhesive on it.

Figure 2:
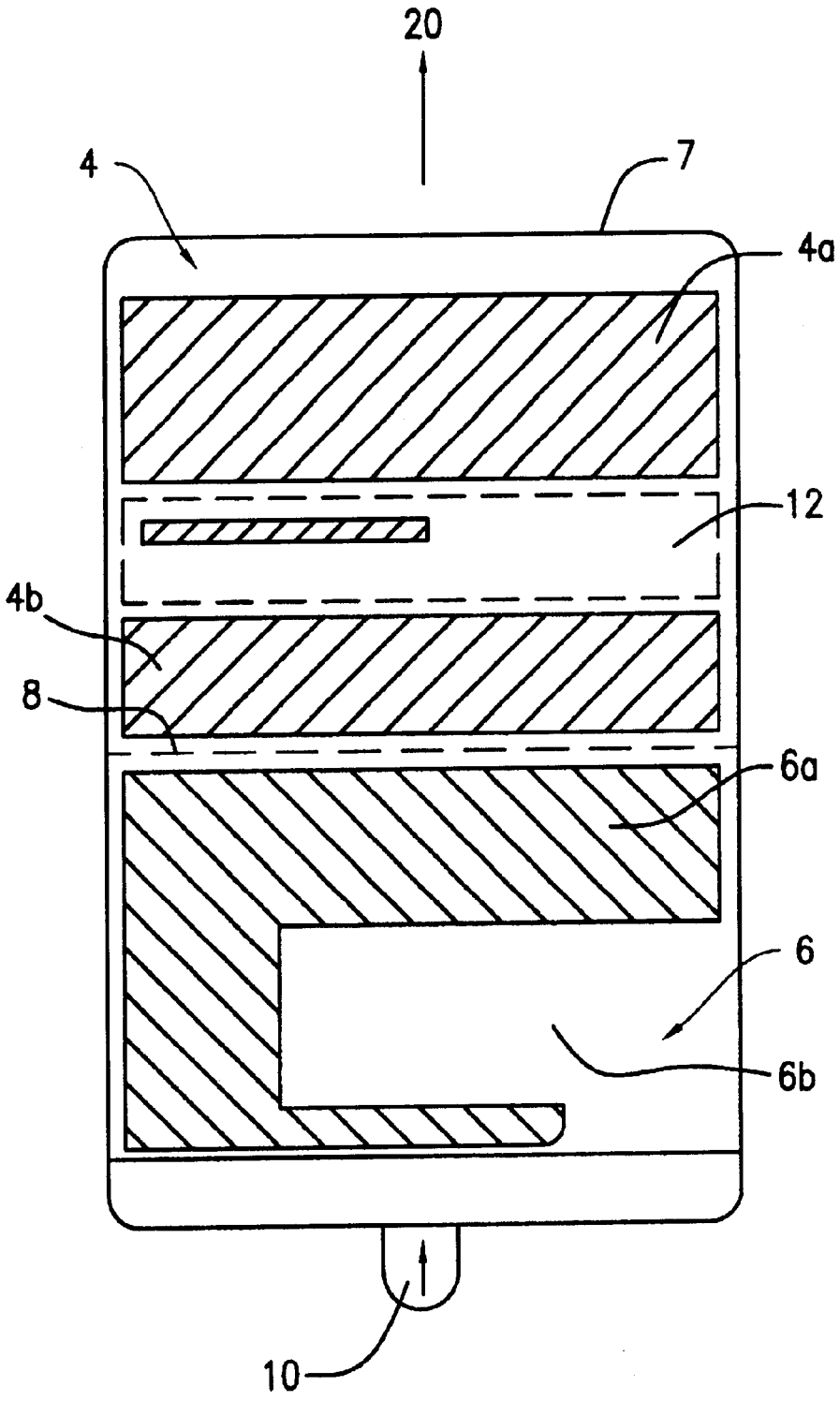
FIG. 2 is a top plan view of the label before attachment to the cartridge.

Referring to FIG. 2, a top plan view of the label is shown, before it has been applied to a container. The second label part 6, in this example where the label is for a cartridge of pharmaceutical diluent, gives information relating to the diluent itself. This is provided on information area 6*a*, which is preprinted when the label is manufactured, and on information area 6*b*where the pharmaceutical manufacturer can add further information such as the batch number and expiry date of the diluent in the cartridge, for example using a thermal transfer printer.

Once the second label part 6 has been detached, the first label part 4 will be uncovered which gives information relating to the reconstituted drug. This is provided on information areas 4*a* and 4*b*, which again is preprinted when the label is manufactured. In addition, a marking panel 12 is provided in order to allow a user to write the date of reconstitution and/or a 'use by' date calculated from the reconstitution date. The marking panel will thus have a different surface to the rest of the label e.g. by being a different material. The calculation may be assisted with the aid of preprinted information on area 4*a* or 4*b*, such as "use within 14 days of reconstitution".

Figure 3:
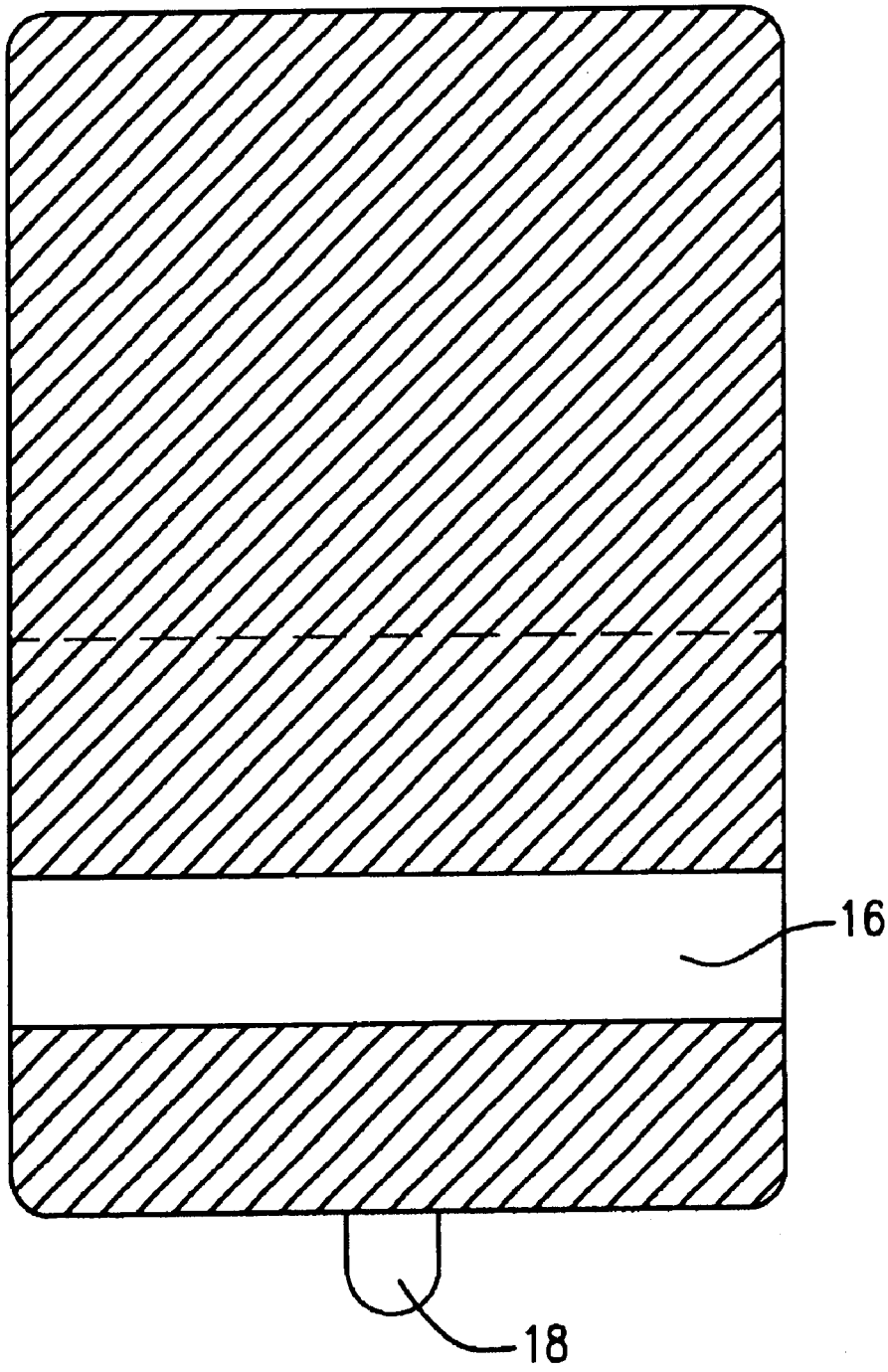
FIG. 3 is an underneath plan view of the label.

Referring to FIG. 3, this shows two areas of the underside of the label which do not have adhesive applied to them. Area 16 of the underside is free of adhesive and is intended, in use, to overlie the marking panel 12. This area is kept free from adhesive to avoid leaving a residue on the marking panel 12 when the second label part 6 is removed. The second area 18 corresponds to the underside of the tab 10. This is left free of adhesive so that the tab 10 does not adhere to the container and so is easy to grip. The rest of the underside of the label is covered with adhesive although the underside of the first label part 4 has additional and/or stronger adhesive applied as compared to the underside of the second label part 6.

The labels are applied to the cartridge 2 by revolving the latter whilst pressing the label against the revolving cartridge. The cartridge takes up the first label part 4 in its first revolution in the direction shown by the arrow 20 in FIG. 2. Completion of the first revolution is followed by a small further rotation to overlap the first label part 4 over itself for a distance of length 9 (see FIG. 1). During a second revolution the second label part 6 is wrapped around the cartridge. A little more than two revolutions of the cartridge 2 are thus necessary to apply the label.

Application of a label to a cartridge may be done e.g. by slowing down a known labelling machine, such as the ESA 1001/1002/1010 manufactured by Bausch and Ströbel, to revolve each container a little more than twice before ejecting it. Such a machine is provided with a programmable logic controller (PLC) and can thus be programmed to effect the increased amount of container rotation, as compared to the usual single revolution. The containers are held in a 'star wheel' which is generally circular but has a number of radial projections so designed as to receive cylindrical containers between them. Multiple self-adhesive labels are provided on a backing strip formed into a roll which feeds the machine.

It will be appreciated by those skilled in the art that a number of variations and modifications may be made without departing from the scope of the present invention. For example, the label described herein need not be applied to a container for diluent and may be used in conjunction with any container for which it is desirable to be able to change its label quickly and simply. It is also not necessary for the container to be right-circular cylindrical. It could equally be any other shape, with manual application of labels if necessary. Furthermore, although only two label parts have been shown and described, this may easily be extended to three or more label parts if the particular application warrants it.

What is claimed is:

1. A label for a container, comprising a first label part to be adhesively attached to the container, said first label part comprising a marking panel and an information area and having a first underside, said information area having information preprinted thereon and said marking panel having a different surface from the information area, and said label further comprising a second label part to be adhesively attached to the first label part for covering the marking panel and said second label part having a second underside, the second underside having an area intended to overlay the marking panel and a remaining area, wherein the area of the second underside intended to overlay the marking panel is free of adhesive and substantially the remaining area of the second underside and substantially all of the first underside have adhesive applied thereto, and in use, said second label part is detachable to uncover said marking panel to allow information to be added to a resulting uncovered portion of the marking panel after detachment of said second label part.

2. A label as claimed in claim 1, wherein said first and second label parts are joined by a tearable join.

3. A label as claimed in claim 2, wherein the first label part has a peel strength and a tearable join having a tearing strength, and wherein the adhesive attachment of the first label part to the container is such that the peel strength of the first label part is greater than the tearing strength of the tearable join.

4. A label as claimed in claim 1, wherein the first label part has a greater peel strength than the second label part.

5. A label as claimed in claim 1, wherein the second label part has a tab to aid detachment thereof.

6. A method of applying a label as claimed in claim 1 to a container, comprising adhesively attaching said first label part comprising said marking panel to the container and detachably covering at least a portion of the marking panel with said second label part by adhesively attaching said second label part to said first label part.

7. A container having a label as claimed in claim 1 adhesively attached thereto.

8. A container as claimed in claim 7, wherein the label is wrapped around the container and the second label part has a circumferential length substantially equal to the circumference of the container.

9. A container as claimed in claim 7, wherein the label is wrapped around the container and the first label part has a circumferential length greater than the circumference of the container.

10. A container as claimed in claim 7, containing a diluent for reconstituting a pharmaceutical composition.

11. A container as claimed in claim 7 containing a pharmaceutical composition.

* * * * *